United States Patent [19]

Takahashi et al.

[11] Patent Number: 4,715,436

[45] Date of Patent: Dec. 29, 1987

[54] CONSTRUCTION OF A HEAT TRANSFER WALL OF A HEAT TRANSFER PIPE

[75] Inventors: Kenji Takahashi, Abiko; Heikichi Kuwahara, Ibaraki; Takehiko Yanagida, Tsuchiura; Wataru Nakayama, Kashiwa; Kiyoshi Oizumi, Tsuchiura; Shigeo Sugimoto, Ibaraki, all of Japan

[73] Assignees: Hitachi, Ltd.; Hitachi Cable, Ltd., both of Tokyo, Japan

[21] Appl. No.: 777,362

[22] Filed: Sep. 18, 1985

[30] Foreign Application Priority Data

Oct. 5, 1984 [JP] Japan ..... 59-208290

[51] Int. Cl.[4] ..... F28F 13/18; F28F 19/02

[52] U.S. Cl. ..... 165/133; 165/179; 165/110; 165/184

[58] Field of Search ..... 62/527; 138/38, 177; 165/133, 177, 179, 184, 110

[56] References Cited

U.S. PATENT DOCUMENTS

| | | | |
|---|---|---|---|
| 3,481,394 | 12/1969 | Withers, Jr. | 165/179 |
| 3,734,140 | 5/1973 | Nakamura et al. | 138/177 |
| 3,847,212 | 11/1974 | Withers, Jr. et al. | 165/179 |
| 4,166,498 | 9/1979 | Fujie et al. | 165/133 |
| 4,314,587 | 2/1982 | Hackett | 138/38 |
| 4,330,036 | 5/1982 | Satoh et al. | 165/184 X |
| 4,332,294 | 6/1982 | Drefahl et al. | 165/177 X |
| 4,425,942 | 1/1984 | Hage et al. | 138/38 |
| 4,549,606 | 10/1985 | Sato et al. | 165/184 X |

FOREIGN PATENT DOCUMENTS

| | | | |
|---|---|---|---|
| 0008995 | 1/1983 | Japan | 165/133 |
| 0208595 | 12/1983 | Japan | 165/133 |
| 862458 | 3/1961 | United Kingdom | 165/177 |
| 2037974 | 7/1980 | United Kingdom | 165/133 |

*Primary Examiner*—William R. Cline
*Assistant Examiner*—John K. Ford
*Attorney, Agent, or Firm*—Antonelli, Terry & Wands

[57] ABSTRACT

A heat transfer tube has at least a row of projections provided on its inner surface at regular intervals along a spiral curve thereof. The row of projections are formed by plastic deformation of part of the heat transfer tube, which is effected by pressing a rolling disc having projections against the outer surface of the heat transfer tube. The projections have smooth curved surfaces. The height of the projections ranges from 0.45 mm to 0.6 mm, their pitch along the spiral curve ranges from 3.5 mm to 5 mm, and their pitch in the axial direction ranges from 5 mm to 9 mm.

1 Claim, 12 Drawing Figures

CONSTRUCTION OF A HEAT TRANSFER WALL OF A HEAT TRANSFER PIPE

BACKGROUND FIELD OF THE INVENTION

This invention relates to a heat transfer tube for heat exchangers such as an air conditioner and a refrigerating machine, and, more particularly, to the structure of a heat transferring surface suitable for a single phase flow heat transfer tube having rows of projections therein.

In, for example, U.S. Pat. No. 3,734,140, a heat transfer tube is provided in a heat exchanger such as an air conditioner or a refrigerating machine, with the heat transfer tube having projections formed by forming primary grooves with a rolling plug inserted into the inside wall of the tube and thereafter further forming secondary grooves by additional machining, as well as a smooth tube having the inner surface structure which has not been subjected to any machining.

If a heat transfer tube having projections is used as a single phase flow heat transfer tube, much force for driving fluid is required because the configuration of the projections is not rounded but has acute angled corners, whereby a separation vortex is produced by a flow component which turns the corner, as will be described in detail later, whereby the fluid suffers a pressure loss between the inlet and outlet of the heat transfer tube. In addition, with respect to the faces of the projections which are perpendicular to the streamline of fluid, the fluid stagnates at those portions and the kinetic energy constitutes the collision pressure, whereby the portions become worn in over long period of time. This wear varies the height and configuration of the projection from its optimum values, and hence the initial heat transfer performance cannot be maintained. Furthermore, it is necessary to form the primary and secondary grooves in this method of using the rolling plug, which leads to an increase in machining steps and hence a rise in costs. It is also inconvenient that the dimension of projection which brings about the maximal effect on heat transfer is unobvious. In spite of the necessity for investigation by systematic experiments on the optimum values of the height, circumferential pitch and the pitch in the axial direction of projections, such values as might serve as parameters influencing heat transfer performance have not been made clear.

Accordingly, the aim underlying the present invention resides in solving the above-described problems of the structure of the inner wall of a heat transfer tube experienced in the prior art, and to provide the structure of a heat transferring surface of a heat transfer tube with projections having an optimum configuration numerically determined such as to provide the maximum transfer heat performance.

To achieve the aim, according to the invention the structure of a heat transferring surface is provided which is efficient in terms of heat transfer performance and is realized by forming a row of projections on the inner surface of a tube, the height of the projections ranging from 0.45 mm to 0.6 mm, the circumferential pitch ranging from 3.5 mm to 5 mm, and the pitch in the axial direction ranging from 5 mm to 9 mm, by pressing a rolling disc having a row of projections on the outer periphery thereof.

The above aim and other objects, features and advantages of the present invention will become clear from the following description of the preferred embodiments thereof, taken in conjunction with the accompanying drawings.

DETAILED DESCRIPTION

Figure 1A:
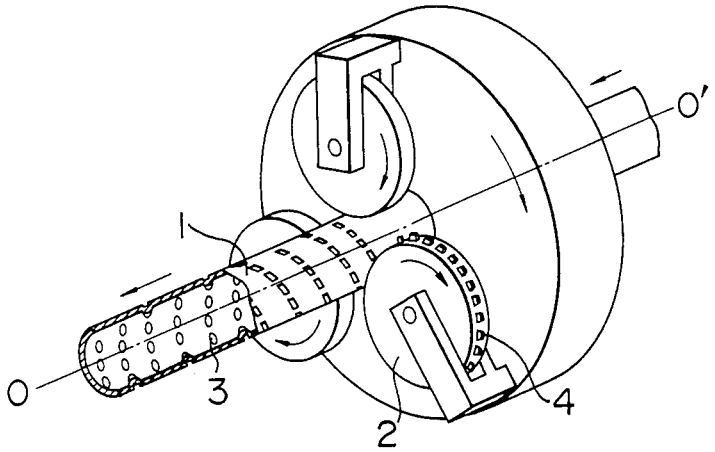
FIG. 1*a* is a perspective view of the structure of a heat transfer tube according to the invention and the manufacturing method thereof.
Figure 1B:
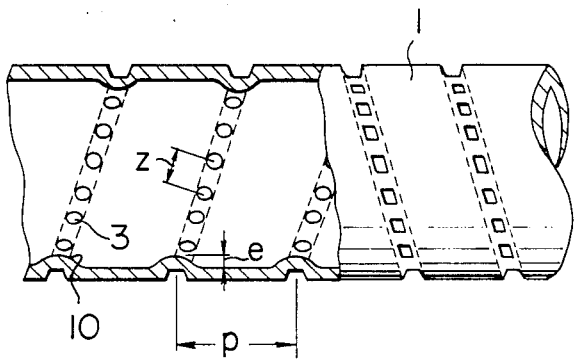
FIG. 1*b* is a partial sectional view of the structure of the heat transfer tube according to the invention.

Referring now to the drawings wherein like reference numerals are used throughout the various views to designate like parts and, more particularly, to FIGS. 1*a*, 1*b*, according to these figures, a heat transfer tube 1 is provided with a spiral row of projections 3 on the inner wall by pressing a rolling disc 2 having gear teeth on the outer edge thereof against the heat transfer tube 2 from the outside. Each of the projections 3 formed on the inner wall surface 10 of the tube 1 is composed of a smooth curved surface formed by plastic deformation of the material of the tube wall by virtue of the external force applied from the outside. The configuration of the bottom of the projection 3 and the cross section at an arbitrary height of the projection 3 are a circle, ellipse, or asymmetrical elliptic curve and the cross sectional area of the projection 3 decreases in the direction of the height of the projection 3.

The pitch z along the spiral curve of the projections 3 is determined by the circumferential pitch of the teeth 4 provided with the rolling disc 2, and the height e of the projection 3 can be varied by controlling the amount of the pressing of the rolling disc 2. It is also possible to vary the spiral lead angle and the pitch p of the projection in the axial direction of the tube 1 by varying the angles of the rolling disc 2. It is possible to vary the spiral lead angle and the pitch p in the axial direction by varying the angle of the rolling disc 2. The pitch p can also be varied by providing a plurality of rolling discs and varying their intervals between them.

Since the projections 3 of a heat transfer tube 1 according to the invention have smooth surfaces, when flow collides with the projections 3, it does not turn sharply but flows along the projections 3, whereby less shear stress due to the viscosity of the fluid is applied on the wall surface and hence the corrosive action resulting from the shear stress is reduced. Furthermore, since the amount of separation vortex generated in the down stream of each projection 3 is small, the corrosive action by virtue of the force of the fluid is also very small.

Among the parameters which have influence on the performance of the heat transfer tube 1, notice was given to the height, the pitch along the spiral curve and the pitch in the axial direction, of the projections 3 and their effects have been made clear after experiments. The inner diameter of the heat transfer tube used in the experiments ranged from 14.7 mm to 15.8 mm.

With respect to the projections 3, the pitch p in the axial direction was fixed at 7 mm, and the pitch z along the spiral curve at 4.5 mm, and the height e was varied at 0.45 mm, 0.5 mm and 0.6 mm. The coefficient of heat transfer and the pressure loss were measured, and the results were arranged on the basis of the Reynolds number Re ($Re=u \cdot d/v$, u: average velocity of fluid in the tube (m/s), s), d: the inner diameter of the tube (mm), v: coefficient of kinetic viscosity ($m^2/s$)); infinitely dimensional coefficient of heat transfer $N_u/Pr^{0.4}$ ($=\alpha d/\lambda/Pr^{0.4}$, $\alpha$: coefficient of heat transfer ($W/m^2 \cdot K$), $\lambda$: coefficient of thermal conductivity of fluid ($W/m^2 \cdot K$), Pr: Prandtl number of fluid); and coefficient of resistance of passage f.

The results obtained were evaluated on the basis of the following formula, which is described in R. L. Webb and E. R. G. Eckert "application of Rough Surfaces to Heat Exchanger Design", International Journal of Heat and Mass Transfer, Vol. 15, p. 1647 to p. 1658, 1972:

$$(st/st_0)/(f/f_0)^{\frac{1}{3}}$$

(st=Nu/Re/Pr) (subscript 0; smooth tube)

The value of the formula is 1 with respect to a smooth tube, and increases with the increase of heat transfer performance. When the flow rate of water is 2.5 m/s, and the Reynolds number calculated from the physical properties of the heat transfer tube in correspondence with the refrigerating machine to which this heat transfer tube is applied is $3 \times 10^4$, the results are arranged as is shown in FIG. 2.

Figure 2:
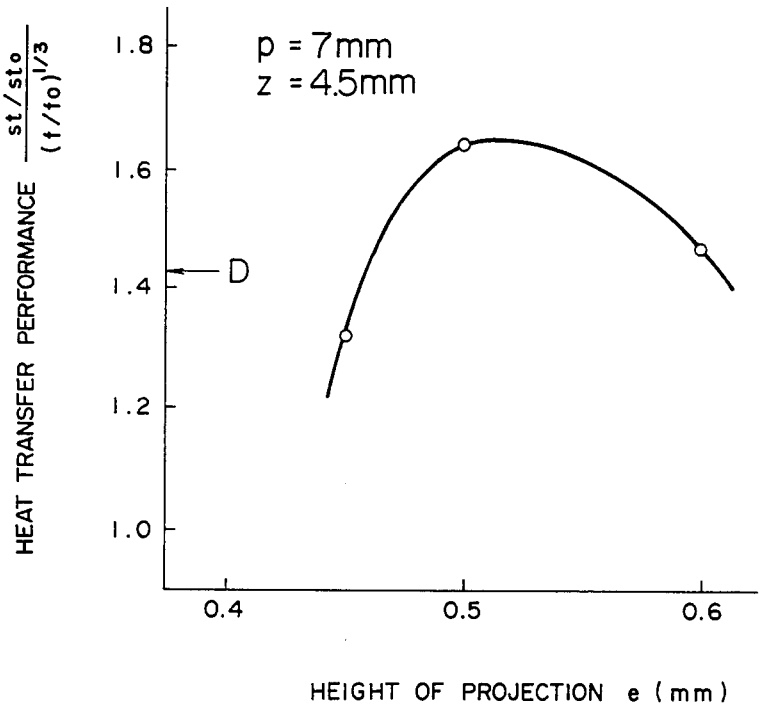
FIG. 2 is a graph of a relationship between the height of a projection in the tube shown in FIG. 1*b* and its heat transfer performance.

As apparent from FIG. 2, the heat transfer performance is the highest when the heat transfer tube 1 has projections 3 having a height of 0.5 mm, and when the height of the projections 3 is more or less than 0.5 mm, the heat transfer performance takes lower values. It is considered that the optimum height of the projections 3 is related to the boundary layer of fluid in the vicinity of the wall surface and takes an approximately constant value, though the value varies slightly according to the diameter of the tube or the like. The heat transfer performance calculated from the data obtained by an experiment on a conventional tube having ridges (e=0.3 mm, p=4 mm) is 1.43 (D in FIG. 2), and if it is assumed that the characteristics of the invention consist in the range of values above this value, the range of the height of the projections 3 is 0.45 mm to 0.6 mm.

Figure 3:
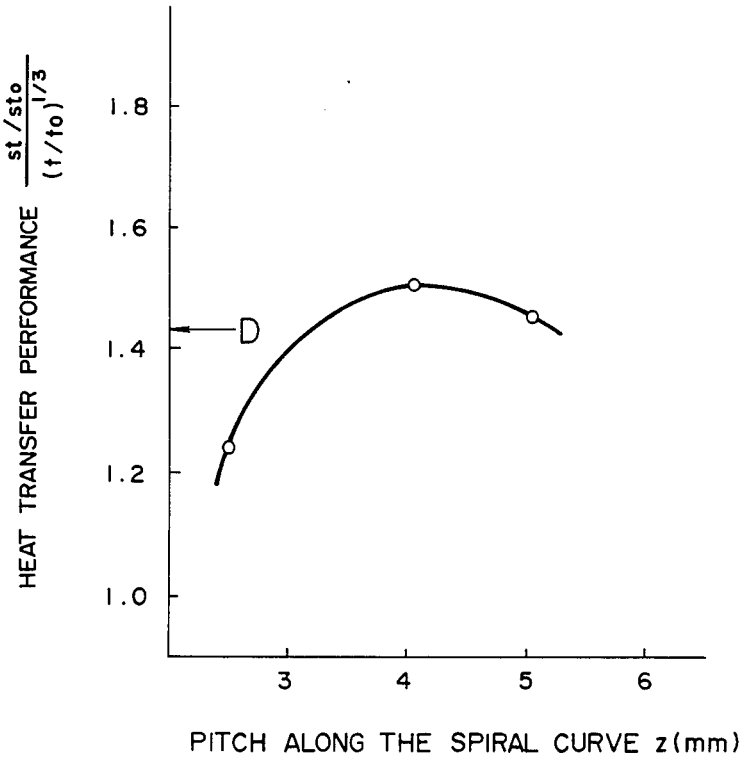
FIG. 3 is a graph of a relationship between the pitch along the spiral curve of the projections in the tube shown in FIG. 1*b* and the heat transfer performance.

The results of a model experiment on the influence of the pitch z of the projections 3 along the spiral curve on the heat transfer performance will next be described. The pitch p in the axial direction was fixed at 7 mm, and the height of the projections 3 was fixed at 0.45 mm, while the pitch z along the spiral curve was varied at 2.5 mm, 4 mm and 5 mm. The coefficient of heat transfer and the coefficent of resistance were measured and the results were arranged on the basis of the formula $st/st_0(f/f_0)^{\frac{1}{3}}$, which generally represents heat transfer performance, and is shown in FIG. 3. The value of the heat transfer performance is the highest in the case of z=4 mm. The symbol D in FIG. 3 represents the value of the heat transfer performance of the above-described conventional tube having ridges (e=0.3 mm, p=4 mm). As is clear from FIG. 3, the structure of the heat transfer tube according to the invention brings about efficient effects. As is the case with the first experiment, if it is assumed that the characteristics of the invention consist in the range of values above the value D, the appropriate range of the pitch along the spiral curve is 3.5 mm to 5 mm.

Figure 4A:
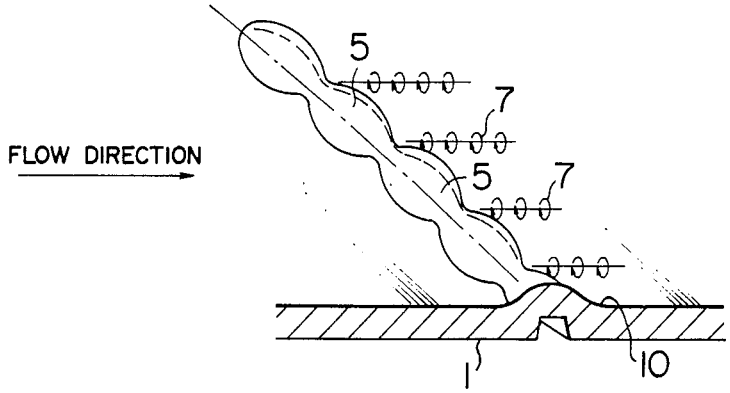
FIGS. 4*a* and 4*b* show the heat transferring mechanism of a tube according to the invention.
Figure 4B:
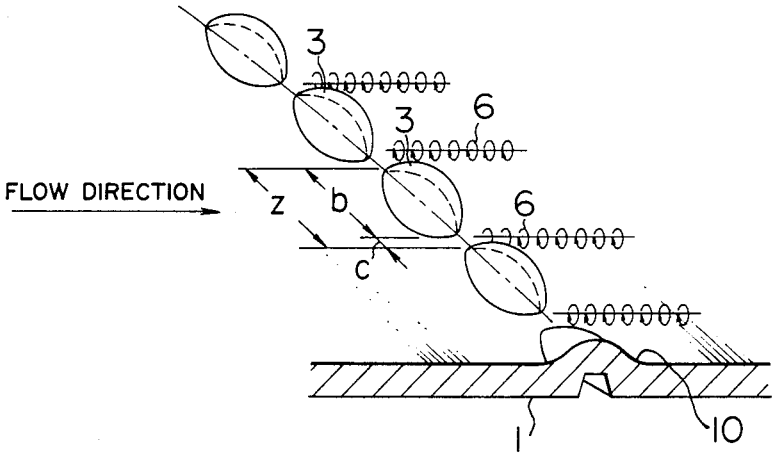

When z=2.5 mm, projections 5 and 5 are connected without any clearance c therebetween, as is shown in FIG. 4*a*. Therefore, the size of a vertical vortex 7 generated between the projections 5 becomes minute as compared with the size of the vertical vortex 6 generated in the case in which there is a clearance c between the projections 3, as is shown in FIG. 4*b*. In other words, if two projections approach to the maximum extent, they constitute a ridge. Therefore, if the clearance c becomes smaller, the heat transfer performance comes closer to that of the conventional tube having ridges.

In the case of z=4 mm, a vertical vortex 6 having its rotational axis in the flow direction is generated from the clearance c between the projections, as is shown in FIG. 4*b*, and this increases the heat transferring effect. The flow passing the ridge separates at the back surface of the ridge and comes into contact with the tube wall again downstream of the ridge, whereby heat is transferred. Conventionally, the pressure loss is increased by the stagnation of the flow immediately behind the ridge, but in the case of the projections according to the invention, the vertical vortex promotes heat transfer, namely, the energy of the flow is effectively utilized for promotion of heat transfer. In this case, the clearance c of the model heat transfer tube was 1 mm, and the distance b of the projection along the spiral curve was 3 mm. Too large a clearance does not increase the heat transferring effect, because it does not generate a vertical vortex which is effective for the promotion of heat transfer. For example, when the pitch z along the spiral curve is 5 mm, the heat transfer performance is lower than when it is 4 mm; that is, an excessive clearance c lowers the coefficient of heat transfer.

Arrangement of the row of projections 3 in a zigzag line can further increase the effect of the vertical vortex, and hence heighten the heat transfer performance.

Figure 5:
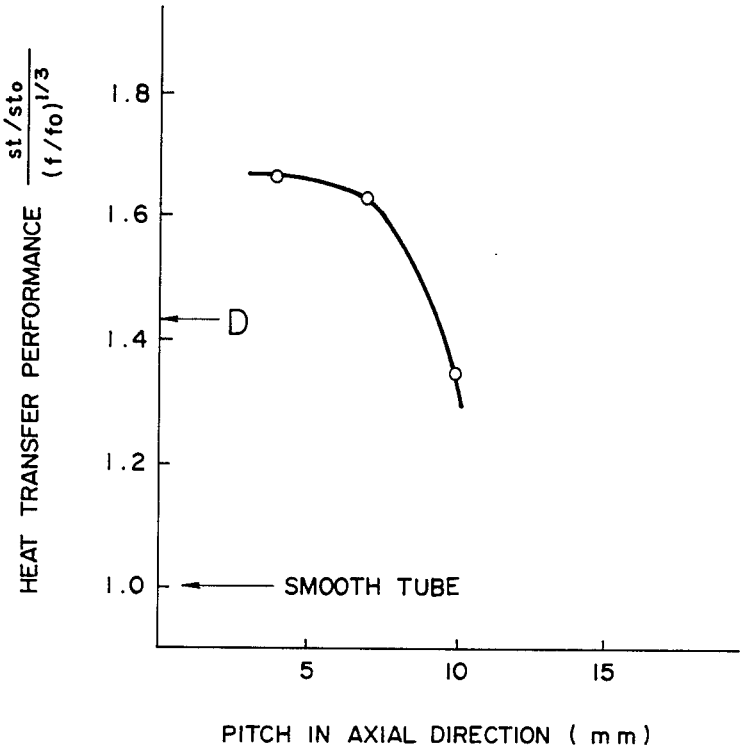
FIG. 5 is a graph of a relationship between the pitch in the axial direction of the projections in the tube shown in FIG. 1*b* and the heat transfer performance.
Figure 6A:
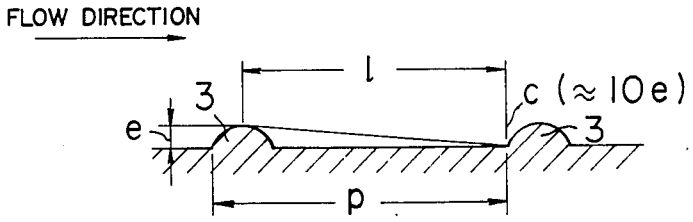
FIGS. 6*a* and 6*b* show the fluid characteristics in the region downstream of each projection.
Figure 6B:
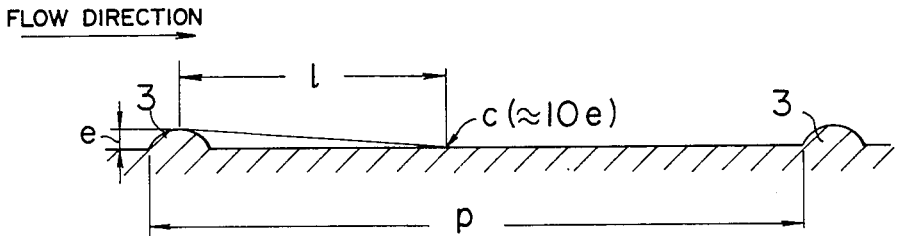

An experiment was carried out on the influence of the pitch in the axial direction under the conditions that the height e of the projection was 0.5 mm and the pitch z along the spiral curve was 4 mm. The pitch p in the axial direction was varied at 5 mm, 7 mm and 10 mm. The experimental values were arranged on the basis of the ratio of the coefficient of heat transfer to the coefficient of resistance $(st/st_0)/(f/f_0)^{\frac{1}{3}}$, as was the case with the previous experiments, the results being shown in FIG. 5. As is clear from FIG. 5, when the pitches are 5 mm and 7 mm, the value of the heat transfer performance is the same, but when the pitch is 10 mm, the value becomes comparatively low in comparison with the former. The reason for this would be as follows. A vortex generated at the portions of the projections 3 is utilized effectively for the promotion of heat transfers, and if the projection on the downstream side of the projection 3 exists within the range of the diffusion of the vortex, the heightened performance is maintained. FIG. *6a* shows this case. The range of the distance in which the vortex diffuses is assumed to be about ten times the height of the projection. When the height of the projection is about 0.5 mm, the portion indicated by the symbol l in FIGS. *6a, 6b* is assumed to be about 5 mm. Therefore, when the pitch in the axial direction is 5 mm and 7 mm, the performance maintains its high value, but when the pitch in the axial direction is 10 mm, the pitch p is longer than the range of distance l of diffusion of vortex, as is shown in FIG. *6b* and the flat portion where no vortex is generated occupies a large portion, so that the heat transferring effect is decreased. As described above, if it is assumed that the characteristics of the invention consist in the range of values above the heat transfer performance D of the conventional tube having ridges (FIG. 5), and in the practical range in which manufacture of the tube is easy, the appropriate range of the pitch in the axial direction is 5 mm to 9 mm.

Figure 7:
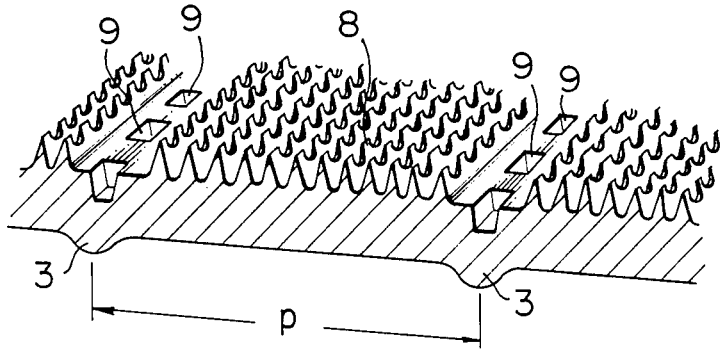
FIG. 7 is a partial cross-sectional perspective view of another embodiment of a heat transfer tube according to the invention.

It is possible, as is shown in FIG. 7, to provide a row of projections 3 within the heat transfer tube, form a saw-toothed row of fins 8 on the outer surface of the tube by knurling and spading with a cutting tool, and utilizing these rows of projections 3 and fins 8 as a concentration heat transferring surface.

A knurling tool having a roll with a plurality of spiral knurling ridges is mounted on a tool rest. The knurling tool is brought into contact with the surface of a heat transfer tube which is rotated while being secured by a chuck. Knurling is conducted by moving the tool rest along the heat transfer tube, whereby spirally continuous shallow grooves are formed on the surface of the tube at a predetermined pitch. This shallow groove may be formed by cutting with a cutting tool in place of knurling.

After the formation of the shallow grooves on the surface of the tube by knurling, cutting is conducted in the transverse direction relative to the groove (for example, at angle of 45°). A plurality of cutting tools are mounted on the respective tool rests and brought into contact with the surface of the rotating tube and cutting operation is conducted in the same way as forming a multiple thread screw. At this time, the surface of the tube is not cut away but is deformed such that the surface is spaded. This spading operation enables the minute and deep grooves to be closely positioned each other.

The fins formed in this way are sharply pointed. The forward end of the fin has notches shallower than the groove, and the bottoms of the notches incline in relation to the surface of the tube. The edges of the notches are sharp and the fins have tapered surfaces.

The embodiment shown in FIG. 7 is used for concentrating Freon refrigerant into liquid by causing the vapor of Freon refrigerant to flow outside the heat transfer tube and cooling water to flow within the tube. In this case, the temperature of the water inside the tube is lower than that of the Freon refrigerant.

Figure 8:
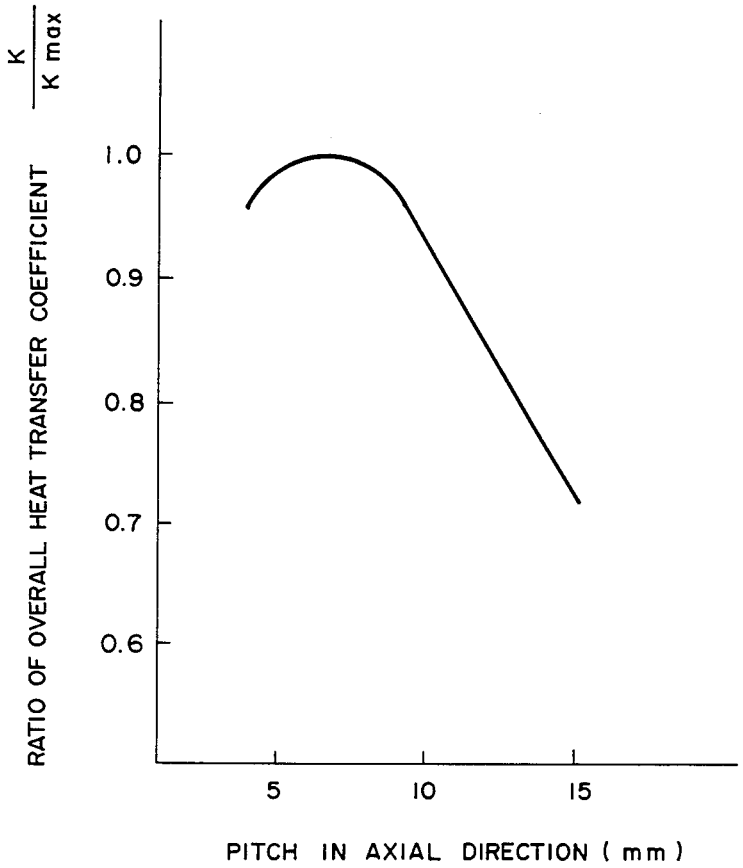
FIG. 8 is a graph of a relationship between the pitch of the projections in the tube shown in FIG. 7 and the heat transfer performance.
Figure 9:
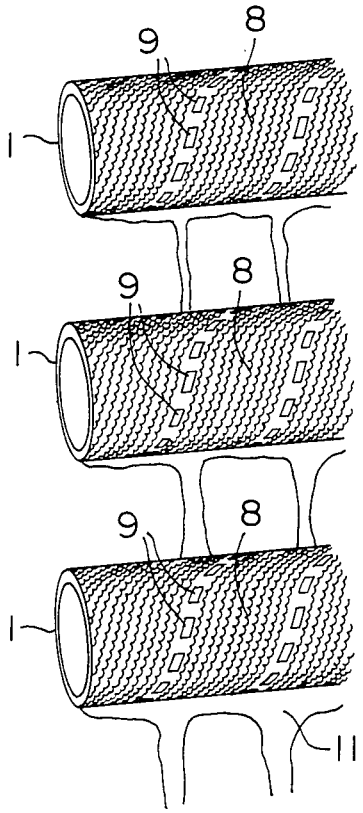
FIG. 9 is a perspective view of still another embodiment of a heat transfer tube according to the invention.

FIG. 8 shows an example of calculation of the overall heat transfer coefficent of a heat transfer tube which has the above-described row of projections therewithin and a concentration heat transferring surface outside thereof. The coefficient of concentration heat transfer $\alpha_0$ outside the tube was calculated by considering the coefficent of heat transfer at the portions of the fins to be 17,400 $W/m^2$ K, and that at the portions of the projections to be 5,800 $W/m^2$ K, and by considering the ratio of the areas. The experimental value shown in FIG. 5 was used as the coefficient of heat transfer $\alpha_1$ inside the tube. The overall heat transfer coefficient K was calculated from the coefficient $\alpha_0$ of concentration heat transfer outside the tube and the coefficent of heat transfer $\alpha_1$ inside the tube. In the case of forming a heat transferring surface within the tube, a rolling disc is used for pressing the surface from the outside of the tube to the inside. If the pitch in the axial direction becomes very small, the rate of the area of the depressions 9 on the outer surface of the tube caused by the pressing operation of the rolling disc in relation to the entire area of the outer surface of the tube becomes rapidly increased, whereby the concentration heat transfer performance outside the tube is rapidly decreased. Accordingly, when the pitch p in the axial direction becomes very small, the total heat transferring efficiency of the tube decreases under the influence of the heat transfer performance outside of the tube in spite of the high performance inside the tube. From observing the above-described phenomenon, it was noted that there is a range of pitches of the projections in the axial direction which is optimum for keeping the total heat transferring efficiency high. From FIG. 8, it can be seen that the optimum range is 5 mm to 9 mm.

When a plurality of concentration heat transfer tubes are used for a heat exchanger, a tube arranged in the lower portion has a thick film of concentrated liquid 11 which acts as thermal resistance, and the lower the position of the tube is, the larger the thickness of the film becomes, because the liquid from the tubes in the upper portions is accumulated. A heat transfer tube according to the invention, however, which is pressed by a rolling disc, has depressions 9 formed at the outer surface of the tube. The concentrated liquid from the saw-toothed heat transferring surface flows into the depressions 9, which serve as reservoirs, and the thickness of the liquid film becomes thinner, whereby the concentration heat transfer performance is increased.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A heat transfer tube comprising:

at least one row of projections provided on an inner surface of said heat transfer tube at regular intervals along a spiral curve thereof, said projections having smooth curved surfaces formed by plastic deformation of a part of said heat transfer tube which is effected by pressing a rolling disc provided with tooth means against an outer surface of said heat transfer tube, said projections having a height ranging from 0.45 mm to 0.6 mm, a pitch along the spiral curve ranging from 3.5 mm to 5 mm, and a pitch in an axial direction ranging from 5 mm to 9 mm;

a plurality of parallel minute grooves formed at a minute pitch on the outer surface thereof;

a plurality of minute fins provided between said grooves; and notches formed on said minute fins and having a depth smaller than said grooves; and wherein a forward end of each of said fins is sharply pointed.

* * * * *